US005816055A

United States Patent [19]

Öhman

[11] Patent Number: 5,816,055

[45] Date of Patent: Oct. 6, 1998

[54] REFRIGERATION SYSTEM ANAD A METHOD FOR REGULATING THE REFRIGERATION CAPACITY OF SUCH A SYSTEM

[75] Inventor: Henrik Öhman, Täby Kyrkby, Sweden

[73] Assignee: Svenska Rotor Maskiner AB, Stockholm, Sweden

[21] Appl. No.: 669,442

[22] PCT Filed: Feb. 3, 1994

[86] PCT No.: PCT/SE94/00083

§ 371 Date: Jul. 10, 1996

§ 102(e) Date: Jul. 10, 1996

[87] PCT Pub. No.: WO95/21359

PCT Pub. Date: Aug. 10, 1995

[51] Int. Cl.[6] ..... F25B 5/00; F25B 41/00

[52] U.S. Cl. ..... 62/117; 62/196.3; 62/197

[58] Field of Search ..... 62/196.3, 197, 62/510

[56] References Cited

U.S. PATENT DOCUMENTS

| | | | |
|---|---|---|---|
| 2,388,556 | 11/1945 | Lathrop | 62/510 X |
| 3,041,848 | 7/1962 | Greenwald | 62/197 |
| 3,568,466 | 3/1971 | Brandin et al. | 62/510 |
| 3,827,250 | 8/1974 | Kerschbaumer et al. | 62/196 |
| 4,084,405 | 4/1978 | Schibbye et al. | 62/197 |
| 4,727,725 | 3/1988 | Nagata et al. | 62/196.3 |
| 4,748,831 | 6/1988 | Shaw | 62/505 |
| 4,899,555 | 2/1990 | Shaw | 62/505 |
| 4,947,655 | 8/1990 | Shaw | 62/200 |
| 5,056,329 | 10/1991 | Wilkinson | 62/197 |
| 5,062,274 | 11/1991 | Shaw | 62/117 |
| 5,063,750 | 11/1991 | Englund | 62/196.3 |
| 5,095,712 | 3/1992 | Narreau | 62/200 |

FOREIGN PATENT DOCUMENTS

| | | | |
|---|---|---|---|
| 0 564 123 A1 | 10/1993 | European Pat. Off. . | |
| 0037253 | 3/1977 | Japan | 62/197 |
| 0037259 | 2/1990 | Japan | 62/197 |

*Primary Examiner*—William E. Wayner

*Attorney, Agent, or Firm*—Frishauf, Holtz, Goodman, Langer & Chick

[57] ABSTRACT

A refrigeration system whose refrigeration capacity can be regulated continuously in a simple and reliable manner by gradually restricting the flow of refrigerant through an economizer channel to the compressor. The refrigeration system includes a rotary screw compressor, a condenser, a first pressure reducing valve, an economizer, a second pressure reducing valve, and an evaporator connected in sequence by respective channels. An outlet channel connects the evaporator to a low pressure inlet port of the rotary screw compressor to form a closed loop for a refrigerant. An economizer channel selectively connects the economizer to a closed working chamber of the rotary screw compressor. An adjustable valve provided in the economizer channel continuously regulates a mass flow of gaseous refrigerant through the economizer channel. And a sensing device senses a value of at least one parameter of the refrigerant in the closed loop which is indicative of a required refrigeration capacity. The adjustable valve is governed based on the at least one parameter sensed by the sensing device, and the at least one parameter is at least one of a temperature of refrigerant in the outlet channel of the evaporator and a pressure of refrigerant in the outlet channel of the evaporator.

12 Claims, 2 Drawing Sheets

REFRIGERATION SYSTEM ANAD A METHOD FOR REGULATING THE REFRIGERATION CAPACITY OF SUCH A SYSTEM

FIELD OF THE INVENTION

The present invention relates to a refrigeration system having a rotary screw compressor, a condenser, first pressure reducing means, an economizer, second pressure reducing means and an evaporator, which elements are connected by channel means in the mentioned sequence and by channel means connecting the evaporator to a low pressure inlet of the compressor port to form a closed loop for a refrigerant and further having economizer channel means selectively connecting the economizer to a closed working chamber of the compressor and adjustable valve means in the economizer channel means.

The present invention also relates to a method for regulating the refrigeration capacity of such a system.

BACKGROUND OF THE INVENTION

The use of an economizer is frequently applied in order to increase the refrigeration capacity of a refrigeration system. When using an economizer a part of the refrigerant is withdrawn from the main loop and is evaporated. The refrigerant evaporated in the economizer is then led to a closed working chamber of the compressor at an intermediate pressure level. The heat required for evaporating the refrigerant is taken from the remaining refrigerant in the main loop, which thereby is subcooled. This is done in a heat exchanger or in a flash tank. By the subcooling of the refrigerant in the main loop the enthalpy difference across the evaporator increases. The components of the system, in particular the compressor, thus can be made smaller and consequently less expensive to manufacture.

In many applications the refrigeration demand may vary widely, which makes it desirable to vary the refrigeration capacity correspondingly. This can be accomplished in various ways; by measures directly affecting the operation of the compressor, by measures affecting the conditions of the flow of refrigerant through the evaporator or by a combination of such measures.

Although the present invention contemplates such a combined regulation in a preferred embodiment the main concept of the invention concerns regulating by means affecting the conditions of the flow of refrigerant through the evaporator. Examples of such systems are disclosed in U.S. Pat. No. 2,388,556, U.S. Pat. No. 4,899,555, U.S. Pat. No. 4,947,655, U.S. Pat. No. 5,062,274 and U.S. Pat. No. 5,095,712. Common to these systems is that the flow of refrigerant withdrawn from the main loop is regulated before it enters the economizer when it still is in the liquid state.

The regulation according to these known systems, however, in some cases requires additional means to attain a satisfactory solution, and in most cases this requires the use of more than one compressor.

SUMMARY OF THE INVENTION

The object of the present invention is to attain a refrigeration system whose refrigeration capacity can be simply and reliably regulated.

According to the present invention a refrigeration system includes a continuously adjustable valve for regulating the mass flow of gaseous refrigerant through the economizer channel, which adjustable valve are governed by sensor for sensing the value of at least one parameter of the refrigerant in the closed loop, which parameter is indicative of the required refrigeration capacity.

Also according to the present invention, a method for regulating the refrigeration capacity, whereby the mass flow of gaseous refrigerant through the economizer channel is continuously regulated by adjustable valve, and whereby the value of at least one parameter of the refrigerant in said closed loop, which parameter is indicative of the required refrigeration capacity, is sensed by a sensor and the sensed value is used to govern the adjustable valve.

The presence of the adjustable valve in the channel from the economizer to the compressor is not novel as such. In the above cited U.S. Pat. No. 4,899,555 and U.S. Pat. No. 4,947,655 as well as in U.S. Pat. No. 3,827,250, U.S. Pat. No. 4,727,725 and U.S. Pat No. 4,748,831 valve means are provided in the channel, but none of these references discloses that the valve means are governed by sensing means in the main loop and none discloses use for regulating the refrigeration capacity of the system.

In a preferred embodiment of the invention the compressor also has a return channel for varying the compressor capacity, in which case the adjustable valve also can control the flow through the return channel.

Preferably the sensed parameter is the temperature of the refrigerant leaving the evaporator.

Further objects and advantages of the invention will be apparent to those skilled in the art by the following detailed description of a preferred embodiment thereof with reference to the accompanying drawings.

DETAILED DESCRIPTION

Figure 1:
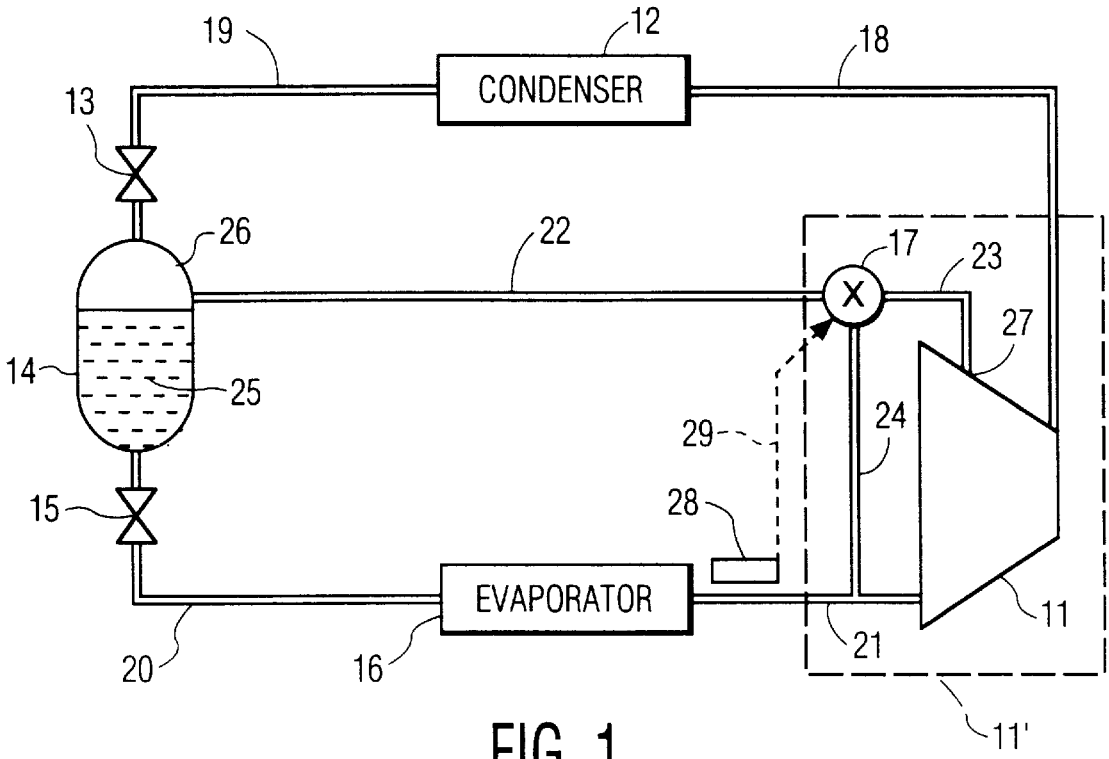
FIG. 1 is a block diagram of a refrigeration system according to the invention.

The refrigeration system illustrated in FIG. 1 includes a rotary screw compressor 11, a condenser 12*a*, a first pressure reducing valve 13, an economizer 14 of the flash tank type, a second pressure reducing valve 15 and an evaporator 16 connected to a closed loop by channels 18, 19, 20 and 21. The upper part of the flash tank 14 containing gaseous refrigerant 26 is by an economizer channel 22, 23 connected to an intermediate pressure port 27 in the compressor 11. The intermediate pressure port 27 faces a closed working chamber of the compressor, i.e. the chamber is sealed off from communication with the inlet as well as the outlet of the compressor. The flow of gaseous refrigerant from the economizer 14 to the compressor 11 is regulated by a valve 17 in the economizer channel 22, 23, which valve is governed by a temperature sensing valve 28 sensing the temperature of the refrigerant in the outlet channel 21 from the evaporator 16.

Since FIG. 1 is a block diagram illustrating the principle of the invention, it is to be understood that the valve 17 not necessary is located in channels outside the compressor. The valve thus advantageously can be arranged within the casing structure (housing 11') of the compressor.

In operation, refrigerant compressed by the compressor flows through channel 18 to the condenser where the refrigerant is condensed by removing heat therefrom. From the condenser 12 the refrigerant flows through a pressure reduction valve 13 to the flash chamber 14. In the flash chamber 14 a part of the refrigerant is evaporated due to the decreased pressure, taking the evaporation heat from the remaining liquid refrigerant 25 gathered in the bottom of the flash tank 14. The thus subcooled refrigerant flows through the pressure reducing valve 15 to the evaporator 16 where it is evaporated by taking up heat. The evaporated refrigerant then flows through channel 21 to the compressor low pressure inlet to be recompressed. The flash gas 26 generated in the flash tank 14 flows through the economizer channel 22, 23 and the valve 17 to the intermediate pressure port 27 in the compressor for recompression. The subcooling of the refrigerant in the flash tank 14 attained by such an economizer coupling increases refrigeration capacity of the evaporator 16, i.e. a larger enthalpy difference across the evaporator 16 is available. The increase in enthalpy difference attained by the economizer is a function of the amount of heat withdrawn from the liquid refrigerant by the refrigerant evaporated in the flash tank 14 and thus depends of the amount of gaseous refrigerant flowing through the economizer channel 22, 23 to the compressor. According to the invention the mass flow through the economizer channel 22, 23 is regulated by a valve 17. Thereby the addition of available enthalpy difference across the evaporator attained by the economizer can be varied. The valve 17 is governed by a temperature sensing device 28 sensing the temperature Te of the refrigerant in the channel 21 connecting the evaporator to the compressor. This temperature is dependent on the heat taken up by the refrigerant in the evaporator and thus is indicative of the demand of refrigeration capacity. Increasing Te means that higher refrigeration capacity is required and affects the valve 17 to move towards a more open position admitting a larger quantity of refrigerant to flow through the economizer channel 22, 23. The system thus adapts to the higher refrigeration demand since the larger mass flow of refrigerant through the economizer channel 22, 23 increases the enthalpy difference. When Te decreases indicating a lower refrigeration demand the valve will act in the opposite direction. Through the valve 17 governed by the temperature sensing device 28, the refrigeration capacity thus can be regulated within a range, the lower limit of which is the refrigeration capacity when the valve is fully closed, i.e. when the economizer is de-activated, and the upper limit of which is the refrigeration capacity when the valve 17 is completely open, making use of the economizer effect to its full extent.

As an alternative to using Te as the governing parameter, the pressure of the refrigerant at the outlet of the evaporator can be used, or a combination of these two.

In order to make it possible to extend the regulation of the refrigeration capacity beyond the lower limit mentioned above in applications where the refrigeration demand may vary considerably, the system can be combined with direct compressor capacity regulation by means of a return channel 23, 24, through which a closed working chamber of the compressor can be brought in communication with the compressor inlet. A part 23 of the return channel 23, 24 is common with the economizer channel 22, 23 as can be seen in FIG. 1. The intermediate pressure opening 27 of the compressor is thus common for both channels and has the dual function of either being an inlet port for the economizer channel 22, 23 or an outlet port for the return channel 23, 24. When such a combined regulation is used the return channel 23, 24 is closed by the valve 17 as long as the latter keeps the economizer channel open, whereby the refrigeration capacity solely is regulated by regulating the economizer flow. When the refrigeration capacity has been regulated down to the lower limit attainable by the economizer regulation, the valve 17 has closed the flow through the economizer channel as described above. Further reduction of the refrigeration demand will affect the valve 17 to open communication between a closed working chamber of the compressor and the compressor inlet, but the economizer channel 22, 23 will remain closed. The valve 17 is arranged to regulate the return flow to the compressor inlet continuously by gradually increasing the flow through the return channel. At its full open position the return flow is large enough to bring down the pressure in the closed chamber to equal the inlet pressure so that the actual compression takes place only downstream of the intermediate pressure port 27.

Figure 2:
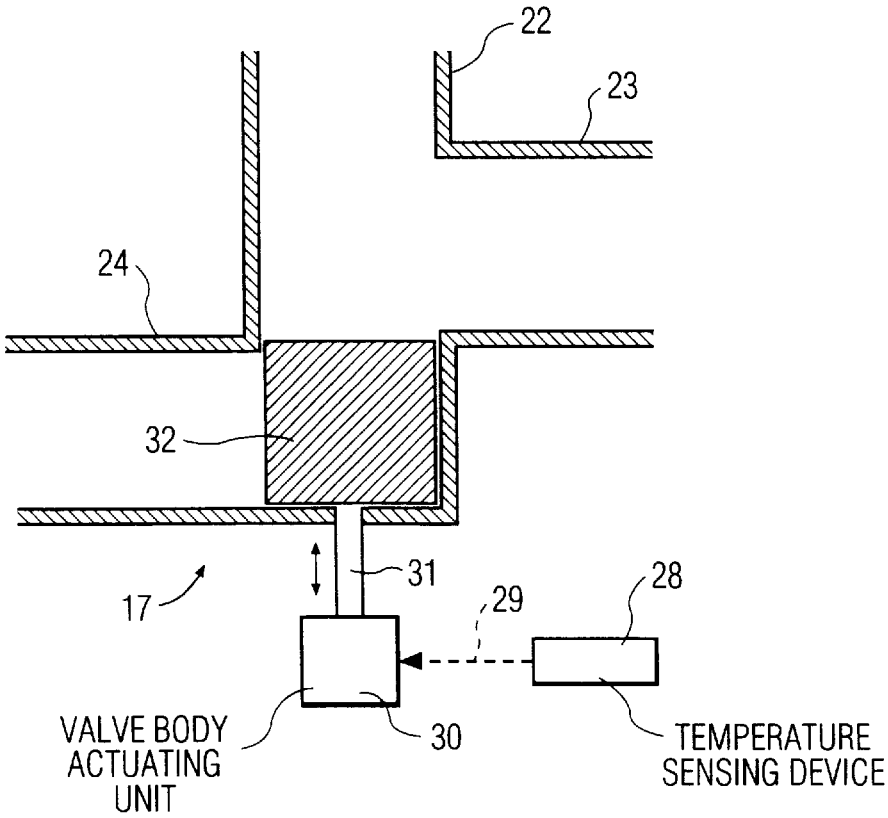
FIG. 2 is a schematic view of the valve means used in the refrigeration system according to the invention.

In FIG. 2 the function of the valve 17 is schematically illustrated. The valve is shown in the position where the system operates at full refrigeration capacity, in which the flow of gaseous refrigerant from the economizer through channel 22 to the compressor through channel 23 is unrestricted, whereas the valve body 32 closes communication between the return channel 24 connected to compressor inlet and the channels 22, 23. Upon movement upwards of the valve body 32 the restriction of the flow of refrigerant from channel 22 to channel 23 will gradually increase which means a decrease in the economizer effect.

Figure 2A:
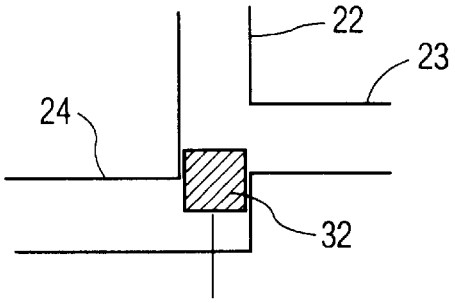
FIGS. 2*a* to *d* are simplified views of the valve means of FIG. 2, illustrating different valve positions.
Figure 2B:
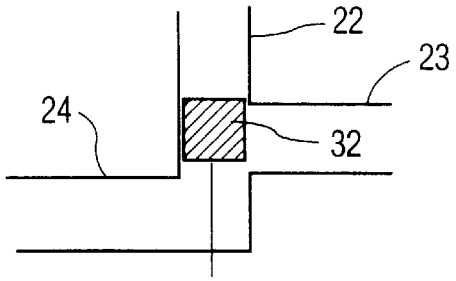

FIGS. 2*a* to *d* illustrate further different positions of the valve body 32, representing various degrees of reduction in refrigeration capacity. In FIG. 2*a* the valve body 32 has moved upwards from the position of FIG. 2 and restricts the flow through the economizer channel 22, 23 so that a reduction of refrigeration capacity is attained by reducing the economizer effect. In FIG. 2*b* the valve body 32 is in the position where the economizer channel 22, 23 is closed, which represents the maximum capacity reduction that can be attained by the economizer regulation. In both FIGS. 2*a* and *b* the return channel 23, 24 is in principle kept closed by the valve body 32 which means that the compressor operates at nominal capacity. In FIG. 2*b*, however, a leakage communication is established between channel part 23 and the return channel 24 in order to avoid a valve position where channel part 23 is completely closed, which would negatively affect the operation of the compressor.

Figure 2C:
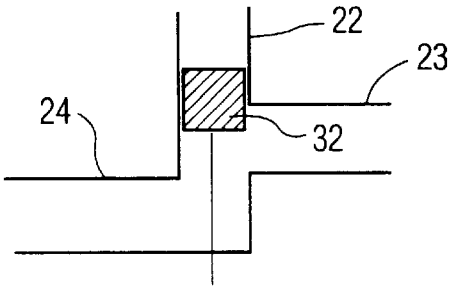
Figure 2D:
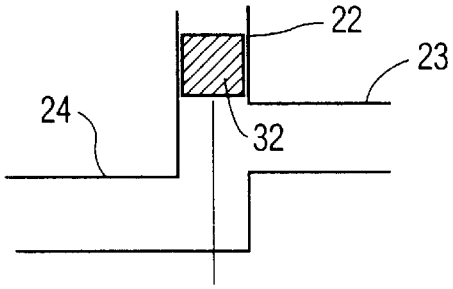

Further upward movement of the valve body 32 from the position of FIG. 2*b* to the position illustrated in FIG. 2*c* will open a restricted communication through the return channel 23, 24 but the economizer channel 22, 23 will remain closed. The compressor capacity thereby will be reduced to a certain degree, depending on how much the valve member 32 opens the return channel 23, 24. In FIG. 2*d* the return channel 23, 24 is fully open, and the pressure in the mentioned closed working chamber will equal inlet pressure. In this position the refrigeration capacity is at the minimum of the regulation range, in which the economizer is de-activated and where the reduction of the compressor capacity attainable by the return channel is made use of to its full extent.

The valve body 32 is moved by an actuating unit 30 through the valve rod 31, which actuating movement is governed by signals transmitted through the signalling circuit 29 from the sensing device 28, sensing the temperature in the evaporator outlet as described above.

The regulation range can be still further extended beyond the lower limit by additional valve means, through which a restricted communication between the economizer and the compressor inlet can be established. Such a modification can be made by admitting upwards movement of the valve body 32 beyond the position in FIG. 2*d* and by designing the connection to channel 22 with tapering decreasing diameter towards the junction with channel 23.

Figure 3:
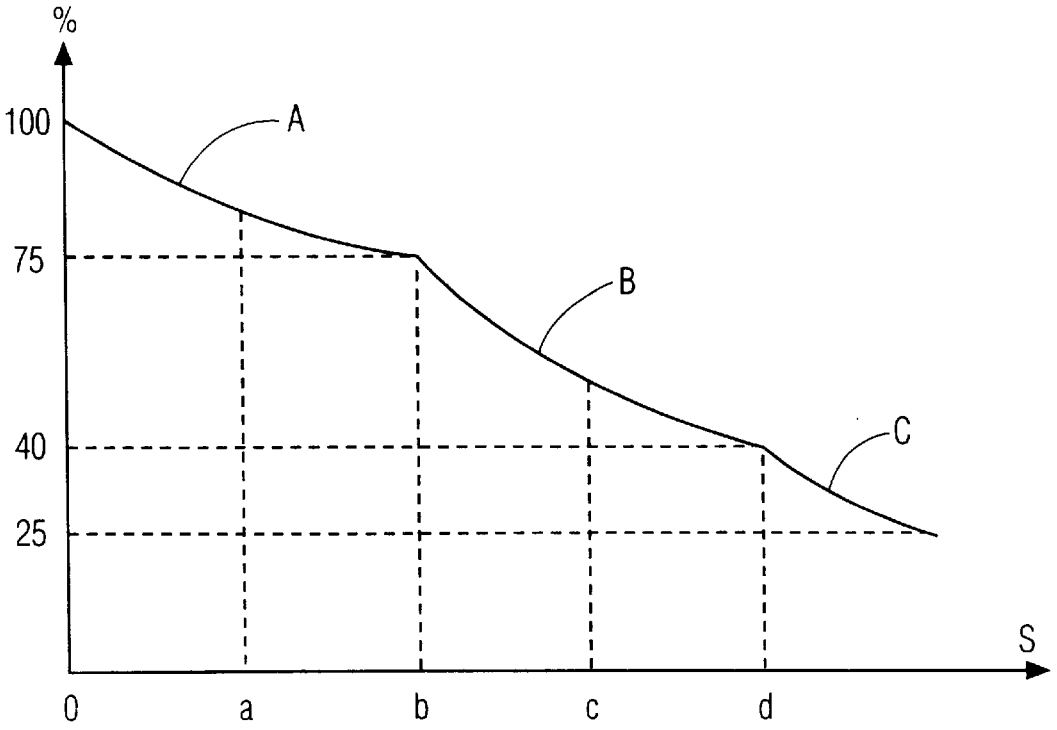
FIG. 3 is a graph illustrating the refrigeration capacity as a function of the valve position.

The regulation is further illustrated by the graph in FIG. 3 showing the refrigeration capacity in percentage of full capacity as a function of the position of the valve body 32, where s is the distance from the bottom position of the valve shown in FIG. 2. In the graph, line A represents the economizer regulation covering the upper range between 75 and 100% of full capacity and line B the compressor regulation covering the lower range between 40 and 75% of full capacity. Points a to d represent the valve positions in figures a to d. Line C represents the additional regulation range down to 25% that can be attained by connecting the economizer to compressor inlet.

According to the present invention as described above the refrigeration capacity of a refrigeration system can be regulated continuously in a simple and reliable way by gradually restricting the flow of refrigerant through the economizer channel to the compressor, thereby regulating the enthalpy difference attained by the economizer coupling, and in applications where a larger regulation range is required, further by gradually opening the compressor return flow, thereby reducing the compressor capacity.

I claim:

1. A refrigeration system comprising:

a rotary screw compressor, a condenser, a first pressure reducing valve, an economizer, a second pressure reducing valve, and an evaporator connected in sequence by respective channels;

an outlet channel connecting said evaporator to a low pressure inlet port of said rotary screw compressor to form a closed loop for a refrigerant;

an economizer channel selectively connecting said economizer to a closed working chamber of said rotary screw compressor;

an adjustable valve provided in said economizer channel for continuously regulating a mass flow of gaseous refrigerant through said economizer channel; and a sensing device for sensing a value of at least one parameter of said refrigerant in said closed loop which is indicative of a required refrigeration capacity;

wherein said adjustable valve is governed based on said at least one parameter sensed by said sensing device, and said at least one parameter is at least one of a temperature of refrigerant in said outlet channel of said evaporator and a pressure of refrigerant in said outlet channel of said evaporator.

2. The refrigeration system according to claim 1, further comprising a return channel selectively connecting said closed working chamber of said rotary screw compressor to said low pressure inlet port of said rotary screw compressor, wherein said economizer channel and said return channel reach said closed working chamber through a common opening.

3. The refrigeration system according to claim 2, wherein said adjustable valve includes a regulating device for regulating a mass flow of refrigerant through said return channel.

4. The refrigeration system according to claim 3, wherein said adjustable valve includes a common valve body for regulating said mass flow of refrigerant through said economizer channel and said mass flow of refrigerant through said return channel.

5. The refrigeration system according to claim 1, wherein said adjustable valve is located in a housing of said rotary screw compressor.

6. The refrigeration system according to claim 2, wherein said adjustable valve is located in a housing of said rotary screw compressor.

7. The refrigeration system according to claim 3, wherein said adjustable valve is located in a housing of said rotary screw compressor.

8. The refrigeration system according to claim 4, wherein said adjustable valve is located in a housing of said rotary screw compressor.

9. A method for regulating a refrigeration capacity of a refrigeration system, said refrigeration system comprising:

a rotary screw compressor, a condenser, a first pressure reducing valve, an economizer, a second pressure reducing valve, and an evaporator connected in sequence by respective channels;

an outlet channel connecting said evaporator to a low pressure inlet port of said rotary screw compressor to form a closed loop for a refrigerant;

an economizer channel selectively connecting said economizer to a closed working chamber of said rotary screw compressor;

an adjustable valve provided in said economizer channel for continuously regulating a mass flow of gaseous refrigerant through said economizer channel; and a sensing device for sensing a value of at least one parameter of said refrigerant in said closed loop which is indicative of a required refrigeration capacity; and said method comprising:

governing said adjustable valve based on said at least one parameter sensed by said sensing device, said at least one parameter being at least one of a temperature of refrigerant in said outlet channel of said evaporator and a pressure of refrigerant in said outlet channel of said evaporator.

10. The method according to claim 9, wherein said closed chamber is selectively connected to said low pressure inlet of said rotary screw compressor through a return channel, and wherein said economizer channel and said return channel reach said closed working chamber through a common opening.

11. The method according to claim 10, wherein a mass flow of refrigerant through said return channel is also regulated by said adjustable valve.

12. The method according to claim 11, wherein said adjustable valve body includes a common valve body for regulating said mass flow of refrigerant through said economizer channel and said mass flow of refrigerant through said return channel.

* * * * *